US010631643B2

(12) United States Patent
Lin et al.

(10) Patent No.: US 10,631,643 B2
(45) Date of Patent: Apr. 28, 2020

(54) HANGING CHAIR

(71) Applicant: Zhejiang Yotrio Group Co., Ltd., Linhai (CN)

(72) Inventors: Huilong Lin, Linhai (CN); Jianping Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 0 days.

(21) Appl. No.: 16/025,196

(22) Filed: Jul. 2, 2018

(65) Prior Publication Data

US 2020/0000232 A1 Jan. 2, 2020

(51) Int. Cl.

| | |
|---|---|
| ***A47C 3/025*** | (2006.01) |
| ***A47C 4/02*** | (2006.01) |
| ***A47C 3/12*** | (2006.01) |

(52) U.S. Cl.

CPC ..... *A47C 3/0255* (2013.01); *A47C 4/02* (2013.01); *A47C 3/12* (2013.01)

(58) Field of Classification Search

CPC ..... A47C 3/0255; A47C 4/02

See application file for complete search history.

(56) References Cited

U.S. PATENT DOCUMENTS

2015/0335136 A1* 11/2015 Wehner ..... A47C 3/0255 297/273

FOREIGN PATENT DOCUMENTS

FR 2961675 A1 * 12/2011 ..... A47C 3/0255

* cited by examiner

*Primary Examiner* — Anthony D Barfield

(74) *Attorney, Agent, or Firm* — Schwegman Lundberg & Woessner, P.A.

(57) ABSTRACT

A hanging chair includes a hanging rod, a base, a connecting assembly and a cover cloth. A side wall of one end of the hanging rod has at least one first mounting hole. The base has a first connection end, and a side wall of the first connection end has at least one second mounting hole. The first connection end and one end of the hanging rod are nested together, such that the first mounting holes correspond exactly to the second mounting holes one to one. The connecting assembly includes at least one welding key and at least one first screw. Each welding key has at least one through hole, and the welding key is disposed at one of the hanging rod and the first connection end. Each first screw passes through the through hole of one welding key, one first mounting hole and one second mounting hole.

6 Claims, 9 Drawing Sheets

HANGING CHAIR

BACKGROUND OF THE INVENTION

Field of the Invention

The present invention relates to a leisure and recreational facility, and more particularly, to a hanging chair.

Description of the Related Art

With the rapid development of the economy and the improvement of people's living standard, the pursuit to life quality is getting higher and higher. The hanging chair is used more and more widely in people's leisure, entertainment and so on.

Currently, there are a plurality of kinds and various styles of hanging chairs on the market. Generally, the size of the hanging chair is large, thus the packing volume of the hanging chair is relatively large and the transportation is relatively difficult. Packing, transportation and warehousing cost account for a relatively large proportion of the sales cost of the hanging chair. How to reduce the packing volume of the hanging chair, and thereby reducing the costs of transportation and warehousing is a difficult problem at present. In addition, when a user does not use the hanging chair, the hanging chair placed in the room also occupies a relatively large space, and the user cannot put away the hanging chair, which is undoubtedly very inconvenient.

Secondly, since the hanging chair needs to be forced to swing during the usage process, the hanging chair needs to bear a relatively large weight, therefore the requirement of structural stability and connection accuracy of the hanging chair itself is relatively high. There is a clearance error exists in the connection between the components of the existing hanging chair, and situations like shaking or loosening between components frequently occur, which is very unsafe, and affect the user's experience.

BRIEF SUMMARY OF THE INVENTION

An objective of the present invention is to provide a hanging chair, which solves problems that the packing volume of the existing hanging chair is relatively large, the existing hanging chair cannot be putted away, and the clearance error exists in the connection of the hanging chair.

To solve above problems, the present invention provides a hanging chair, and the hanging chair includes a hanging rod, a base, a connecting assembly and a cover cloth. A side wall of one end of the hanging rod has at least one first mounting hole. The base has a first connection end, and a side wall of the first connection end has at least one second mounting hole. The first connection end and one end of the hanging rod are nested together, such that the first mounting holes correspond exactly to the second mounting holes one to one. The connecting assembly includes at least one welding key and at least one first screw. Each welding keys has at least one through hole, and the welding key is disposed at one of the hanging rod and the first connection end. Each first screw passes through the through hole of one welding key, one first mounting hole and one second mounting hole, such that the hanging rod is fixed with the first connection end. The chair is suspended at the hanging rod.

According to one embodiment of the present invention, a number of the first mounting holes may be four, and the four first mounting holes may be located at two sides of the hanging rod with two as one group, respectively. A number of the second mounting holes may be four, a number of the welding keys may be two, a number of the through holes of each welding key may be two, and a number of the first screws may be four.

According to one embodiment of the present invention, the first connection end may be nested inside the hanging rod, and the welding key may be disposed at an outer wall of the hanging rod.

According to one embodiment of the present invention, the through hole of the welding key may be a conical hole, and the first screw may be a countersunk head screw.

According to one embodiment of the present invention, the hanging rod may include a first rod piece, a second rod piece and a second screw. The chair may be suspended at one end of the first rod piece, the other end of the first rod piece may have a through hole, and the welding key may be disposed at one end of the second rod piece. The other end of the second rod piece may have a through hole, and the second rod piece may be nested inside the first rod piece such that the through hole of the first rod piece may correspond exactly to the through hole of the second rod piece. The second screw may pass through the through hole of the first rod piece and the through hole of the second rod piece, and a head part of the second screw may get into the through hole of the first rod piece and may be close to a side wall of the second rod piece.

According to one embodiment of the present invention, the base may include a chassis and four supporting legs. The first connection end may be disposed at the chassis. The chassis may have four second connection ends, the four second connection ends may extend along four different directions, respectively, and the four supporting legs may be correspondingly one to one inserted and fixed at the four second connection ends through a screw, respectively.

According to one embodiment of the present invention, the chair may include a chair frame and a cover cloth, and the chair frame may include a first bend pipe, two second bend pipes, a third bend pipe and a straight pipe. The first bend pipe may be U-shaped, and the first bend pipe may be suspended at the hanging rod. The second bend pipe may be C-shaped, and one end of the two second bend pipes may be inserted and fixed at two ends of the first bend pipe through a screw, respectively. The third bend pipe may be "⊏" shape, and two ends of the third bend pipe may be inserted and fixed at the other end of the two second bend pipes through a screw, respectively. Two ends of the straight pipe may be fixed at a top of the two second bend pipes through a screw, respectively, and four edges of the cover cloth may be fixed at the two second bend pipes, the third bend pipe and the straight pipe, respectively.

According to one embodiment of the present invention, the chair may include two armrests. One end of each armrest may be fixed at a junction of one of the second bend pipes and the third bend pipe through a screw, and the other end of each armrest may be correspondingly fixed at the other position of one of the second bend pipes through a screw.

Compared with the prior art, the present technical solution has following advantages:

The present invention strengthens the fixation between the hanging rod and the base by disposing a connecting assembly. Specifically, through the fixation effect of the first screw, an axial displacement or loosening between the hanging rod and the first connection end of the base can be avoided, which ensures the connection accuracy between the hanging rod and the base. By disposing the welding key at the side wall of the hanging rod, the first screw can be strengthened, making the first screw have a relatively large stress contact surface to prevent the first screw from dropping off. In addition, the hanging rod and the base are detachably connected through the connecting assembly of the present invention, what's more, the chair can be detached from the hanging rod, therefore the user can detach the whole hanging chair into three separate parts: the hanging rod, base and chair. It is convenient for packing and transportation, and the packing volume is relative smaller compared to the conventional technology.

In the present invention, by disposing the through hole of the welding key as a conical hole and disposing the first screw as a countersunk head screw, the head of the first screw can be prevented from protruding from a surface of the welding key, such that the first screw is hidden in the welding key and the surface of the welding key keeps flat and beautiful. In addition, the user can be prevented from scratching or bruising by the head of the first screw during the usage process. On the other hand, the shape of the through hole of the welding key matches with the shape of the first screw, in which the first screw is further stabilized, such that one screw has a relatively large and flat stress contact surface to prevent the first screw from being loosened.

In the present invention, the first rod piece and the second rod piece are detachably connected through a second screw, such that the hanging rod can be detached into two separate parts: the first rod piece and second rod piece. It is convenient for packing and transportation, and to further reduce the packing volume of the hanging rod of the hanging chair. In addition, through the head part of the second screw getting into the through hole and being close to the side wall of the second rod piece, the clearance error between the first rod piece and the second rod piece can be eliminated, which prevents the loose caused by not tight nesting between the first rod piece and the second rod piece.

In the present invention, by adopting ways of insertion and screw connection, a detachable connection of the chassis and the supporting leg is achieved, such that the base can be detached into five separate parts: a chassis and four supporting legs, which is convenient for packing and transportation, and further reduce the packing volume of the base of the hanging chair.

In the present invention, by adopting ways of insertion and screw connection, the first bend pipe, two second bend pipes, the straight pipe and the armrest are assembled to be the chair frame, such that the chair frame can be separately detached into a plurality of parts, which is convenient for packing and transportation, and further reduce the packing volume of the chair frame of the hanging chair.

DETAILED DESCRIPTION OF THE INVENTION

The following description is only used for disclosing the present invention such that those skilled in the present field will be able to practice the present invention. The following embodiments described are only for instance, and those skilled in the present field can think of other obvious variations. The basic principles of the present invention as defined in the following description may be applied to other embodiments, variations, modifications, equivalents, and other alternatives without departing from the spirit and scope of the invention.

Figure 1:
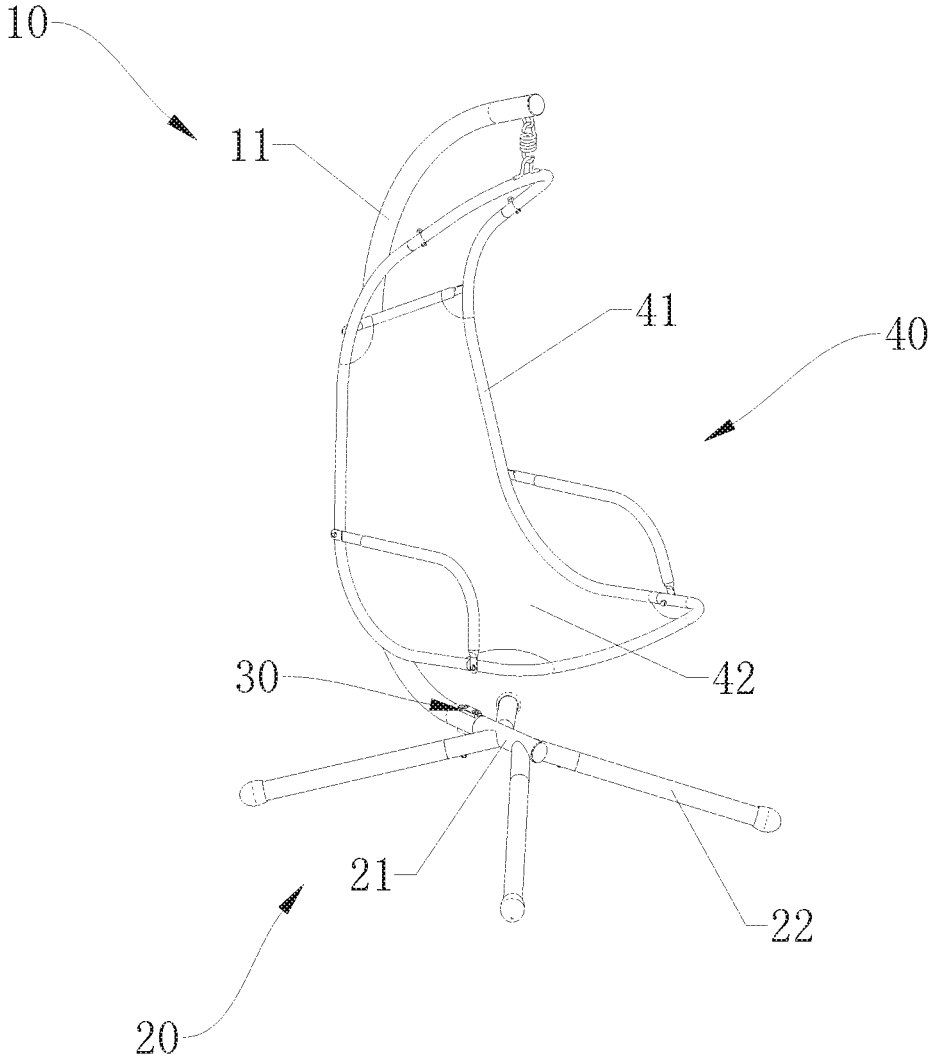
FIG. 1 is a stereo structural schematic diagram of a hanging chair according to an embodiment of the present invention.
Figure 2:
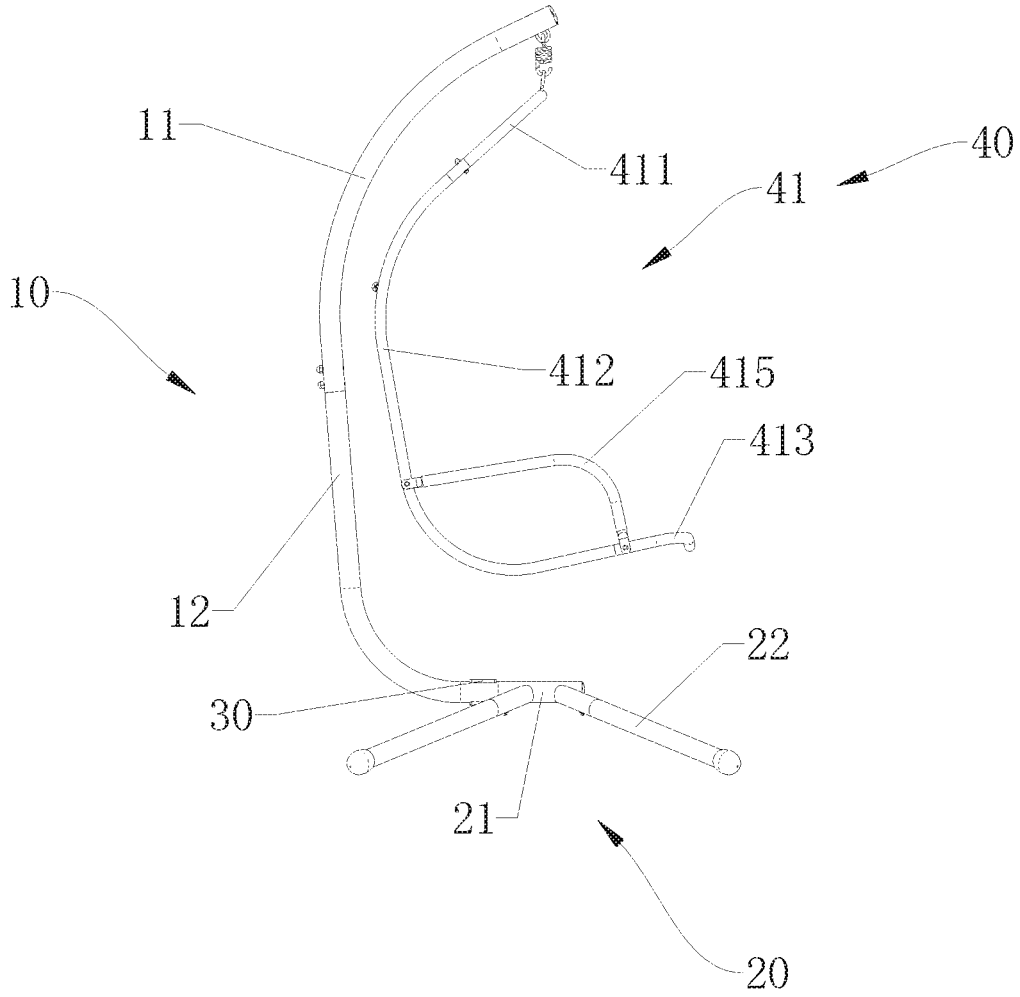
FIG. 2 is a side view of the hanging chair according to an embodiment of the present invention.

As shown in FIG. 1, the embodiment of the present invention provides a hanging chair. In particular, the hanging chair is detachable, which is convenient for packing and transportation. The hanging chair includes a hanging rod 10, a base 20, a connecting assembly 30 and a chair 40.

The hanging rod 10 is used to suspend the chair 40 of the hanging chair, such that the chair 40 can sway. A side wall of one end of the hanging rod 10 has at least a first mounting hole 101. The first mounting hole 101 is a through hole, and the first mounting hole 101 communicates with an interior of the hanging rod 10. In the present embodiment, the number of the first mounting holes 101 is four, and the four first mounting holes 101 are located at two sides of the hanging rod 10 with two as one group, respectively. That is to say, the first mounting holes 101 are disposed at the side wall of the hanging rod 10 symmetrically. In another embodiment, the number of the first mounting hole 101 is one, and the first mounting hole 101 is disposed at one side of the hanging rod 10. In another embodiment, the number of the first mounting holes 101 is three, and the first mounting holes 101 are disposed at the side wall of the hanging rod 10 symmetrically.

Figure 3:
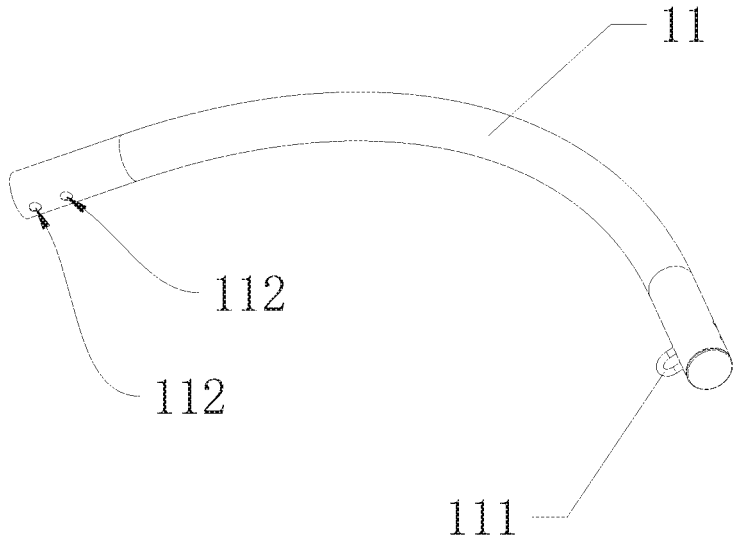
FIG. 3 is a structural schematic diagram of a first rod piece of the hanging chair according to an embodiment of the present invention.

Further, the hanging rod 10 includes a first rod piece 11, a second rod piece 12 and a second screw 13. As shown in FIG. 3, the first rod piece 11 is a bend pipe. One end of the first rod piece 11 has a suspension loop 111, and the suspension loop 111 is used to suspend the chair 40. That is to say, the chair 40 is suspended at one end of the first rod piece 11. The other end of the first rod piece 11 has a through hole 112, and the through hole 112 runs through the first rod piece 11. Optionally, the number of the through holes 112 is two.

Figure 4:
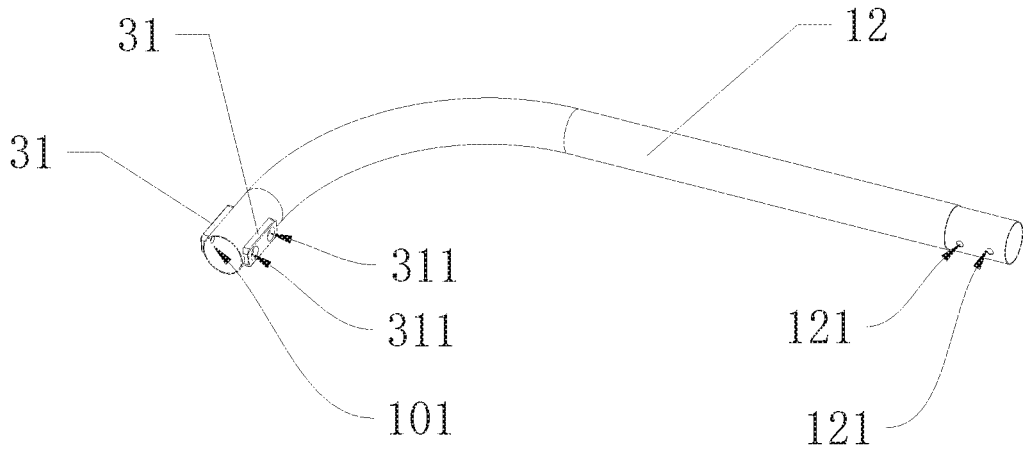
FIG. 4 is a structural schematic diagram of a second rod piece of the hanging chair according to an embodiment of the present invention.

As shown in FIG. 4, the second rod piece 12 is a bend pipe. The first mounting hole 101 is disposed at one end of the second rod piece 12, and the four first mounting holes 101 are located at two sides of the second rod piece 12, respectively. The other end of the second rod piece 12 has a through hole 121, and the through hole 121 runs through the second rod piece 12. The number of the through holes 121 corresponds to the number of the through holes 112. Optionally, the number of the through holes 121 is two. The second rod piece 12 is nested at the interior of the first rod piece 11, such that the through holes 112 of the first rod piece 11 correspond exactly to the through holes 121 of the second rod piece 12.

The second screw 13 passes through the through holes 112 of the first rod piece 11 and the through holes 121 of the second rod piece 12, such that the first rod piece 11 is fixed with the second rod piece 12. What's more, a head part of the second screw 13 partially sinks into the through hole 112 of the first rod piece 11 and closely contacts the side wall of the second rod piece 12. In the present embodiment, both the number of the through holes 112 of the first rod piece 11 and the number of the through holes 121 of the second rod piece 12 are two, and the number of the second screws 13 is correspondingly two. The two second screws 13 correspondingly pass through one through hole 112 of the first rod piece 11 and one through hole 121 of the second rod piece 12, respectively. In other embodiments, the number of the through holes 112 of the first rod piece 11 and the number of the through holes 121 of the second rod piece 12 are other values, and the number of the second screws 13 is correspondingly other value. It can be understood that the size of the through hole 112 of the first rod piece 11 is properly set, such that the head of the second screw 13 only partially gets into the through hole 112 while the second screw 13 cannot pass through the through hole 112 completely; and the part of the second screw 13 got into the through hole 112 closely contacts the side wall of the second rod piece 12, which can eliminate the clearance error between the first rod piece 11 and the second rod piece 12, and prevent the loose caused by not tight nesting between the first rod piece 11 and the second rod piece 12.

The base 20 supports the hanging rod 10. The base 20 has a first connection end 201, and the side wall of the first connection end 201 has at least one second mounting hole 2011. The first connection end 201 and one end of the hanging rod 10 are nested together, such that the first mounting holes 101 corresponds exactly to the second mounting holes 2011 one to one. It can be understood that the number of the second mounting holes 2011 corresponds to the number of the first mounting holes 101. In the present invention, the number of the second mounting holes 2011 is four. Similarly, the four second mounting holes 2011 are located at two sides of the first connection end 201 with two as one group, that is, the second mounting holes 2011 are symmetrically disposed at the side wall of the first connection end 201. In other embodiments, the number of the second mounting holes 2011 is other value, such as one or three.

On the other hand, in the present embodiment, the first connection end 201 of the base 20 is nested at the interior of the hanging rod 10. In other embodiments, one end of the hanging rod 10 is nested at the interior of the first connection end 201 of the base 20.

Figure 5:
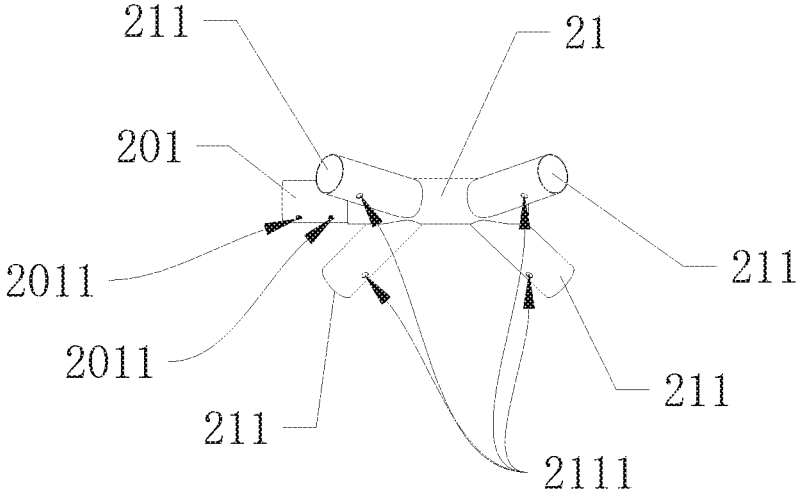
FIG. 5 is a structural schematic diagram of a chassis of the hanging chair according to an embodiment of the present invention.
Figure 6:
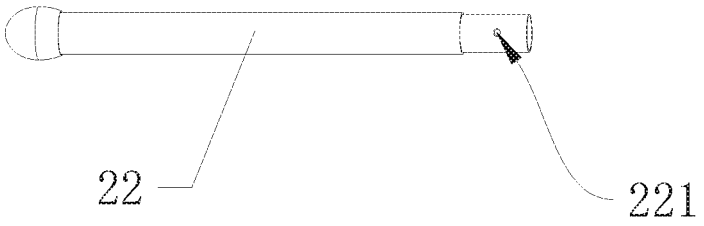
FIG. 6 is a structural schematic diagram of a supporting leg of the hanging chair according to an embodiment of the present invention.
Figure 7:
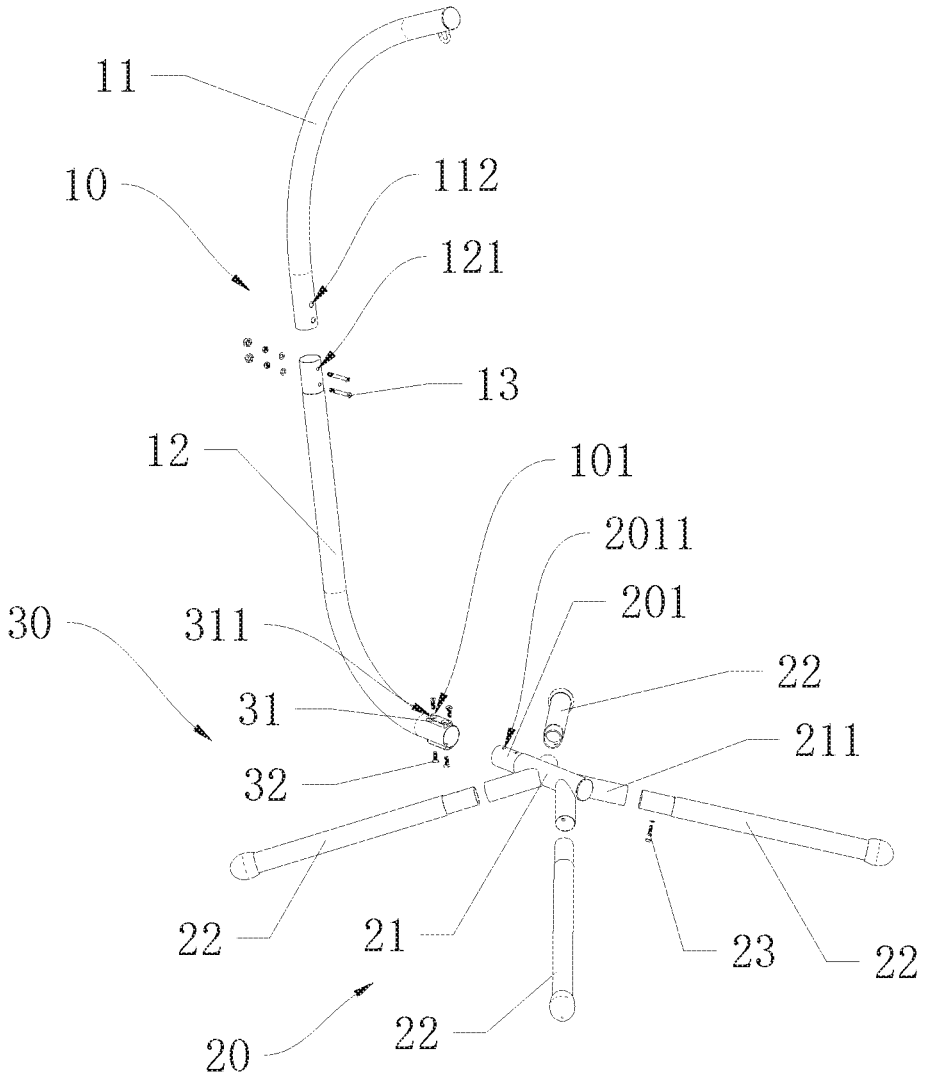
FIG. 7 shows a structural exploded view of a hanging rod and a base of the hanging chair according to an embodiment of the present invention.
Figure 8:
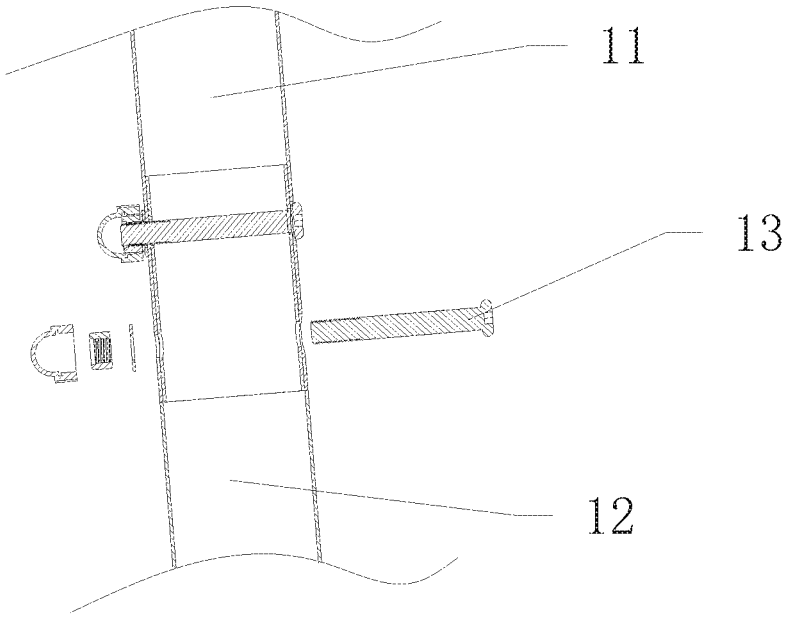
FIG. 8 shows a connection way between the first rod piece and the second rod piece of the hanging chair according to an embodiment of the present invention.
Figure 9:
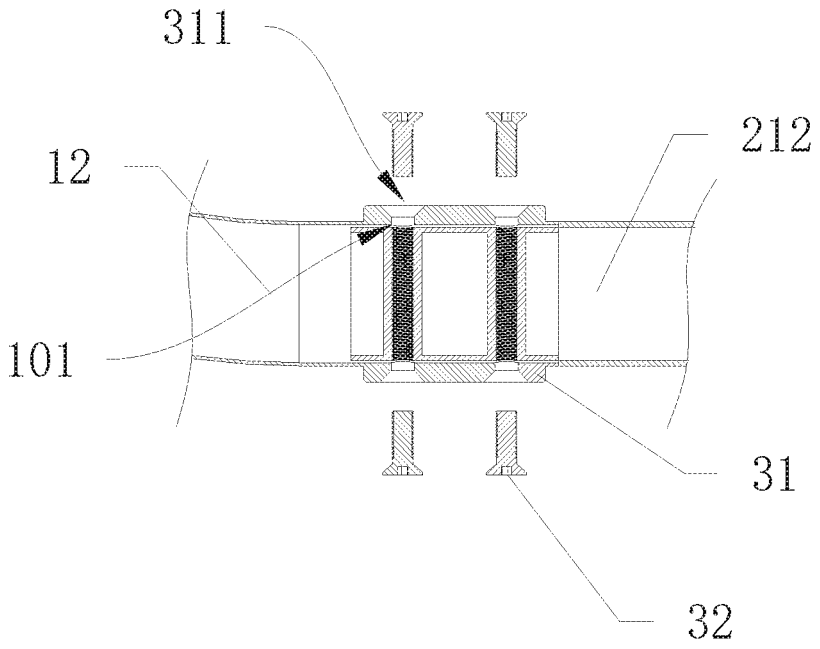
FIG. 9 shows a connection way between the second rod piece and the chassis of the hanging chair according to an embodiment of the present invention.
Figure 10:
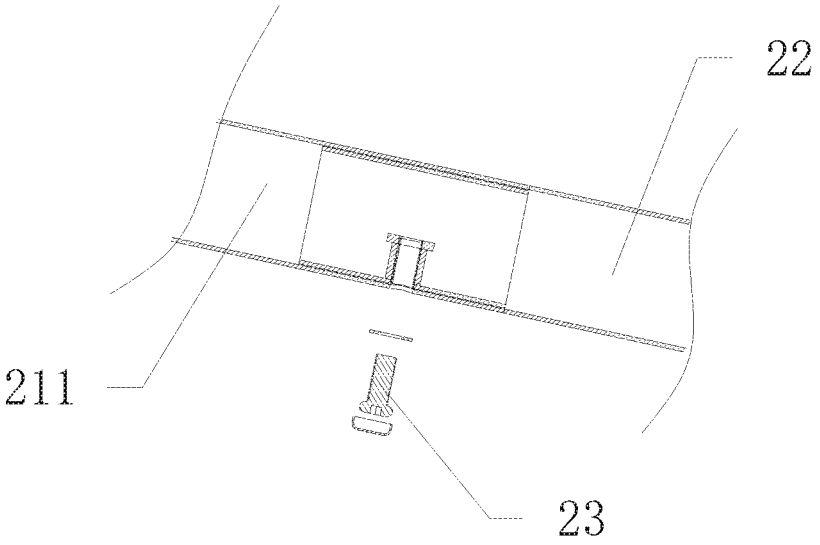
FIG. 10 shows a connection way between the chassis and the supporting leg of the hanging chair according to an embodiment of the present invention.

Further, the base 20 includes a chassis 21 and four supporting legs 22. As shown in FIG. 5, the first connection end 201 is disposed at the chassis 21. The chassis 21 further has four second connection ends 211, and the four second connection ends 211 extend along four different directions, respectively, such that the chassis 21 is claw-shaped.

The four supporting legs 22 are one to one correspondingly inserted and fixed at the four second connection ends 211 through a screw, respectively, to support the chassis 21. In other words, the four supporting legs 22 together support the chassis 21 from four different directions, respectively.

Specifically, the base 20 further includes four third screws 23. One side of each second connection ends 211 has a through hole 2111, that is, the through hole 2111 of the second connection end 211 is a single side hole. Correspondingly, one side of each supporting legs 22 has a through hole 221, and the through hole 221 of the supporting leg 22 is also a single side hole. The four supporting legs 22 are one to one correspondingly inserted to the four second connection ends 211 of the chassis 21, respectively. The through hole 2111 of the second connection end 211 corresponds exactly to the through hole 221 of the supporting leg 22, and each third screws 23 is correspondingly inserted into the through hole 2111 of one second connection end 211 and the through hole 221 of one supporting leg 22, respectively, to fix the second connection end 211 and the supporting leg 22.

The connecting assembly 30 is used to support the hanging rod 10 and the base 20. Specifically, the hanging rod 10 and the first connection end 201 of the base 20 are fixed through the connecting assembly 30 to prevent the hanging rod 10 and the base 20 from being loosened and dropping off. The connecting assembly 20 includes at least one welding key 31 and at least one first screw 32.

Each welding key 31 has at least one through hole 311. The welding key 31 is disposed at one of the hanging rod 10 and the first connection end 201. Specifically, in the present embodiment, the first connection end 201 is nested at the interior of the hanging rod 10, each welding key 31 is disposed at the outer wall of the hanging rod 10, and the welding key 31 and the first mounting hole 101 are located at the same end of the hanging rod 10. In other embodiments, one end of the hanging rod 10 is nested at the interior of the first connection end 201, and each welding key 31 is disposed at the outer wall of the first connection end 201.

The total number of the through holes 311 of the welding keys 31 corresponds to the number of the first mounting holes 101 and the number of the second installation holes 2011. In the present invention, the number of the welding keys 31 is two, and the number of the through holes 311 of each welding key 31 is two, that is, the total number of the through holes 311 of the welding keys 31 is four. Two welding keys 31 are welded at two sides of the hanging rod 10, respectively, such that each through hole 311 corresponds exactly to one of the first mounting holes 101 and one of the second mounting holes 2011. In other embodiments, the number of the welding keys is other value, and the number of the through holes 311 of each welding key 31 is other value. For example, in one embodiment, both the number of the first mounting hole 101 and the second mounting hole 2011 are one, the number of the welding key 31 is one, and the welding key 31 has one through hole 311. For another example, in another embodiment, both the number of the first mounting holes 101 and the number of the second mounting holes 2011 are two, the two first mounting holes 101 are distributed at two sides of the hanging rod 10, and the two second mounting holes 2011 are correspondingly distributed at two sides of the first connection end 201; and the number of the welding keys 31 is two, each welding key 31 has one through hole 311, and two welding keys 31 are correspondingly disposed at two sides of the hanging rod 10 to make the through holes 311 of the welding keys 31 correspond exactly to the first mounting holes 101 and the second mounting holes 2011.

Each first screw 32 passes through the through hole 311 of one welding key 31, one first mounting hole 101 and one second mounting hole 2011, such that the hanging rod 10 is fixed with the first connection end 201. In other words, the hanging rod 10 and the first connection end 201 are fixed through a welding key 31 and a first screw 31. The number of the first screws 32 corresponds to the number of the through holes 311 of the welding key 31, the number of the first mounting holes 101 and the number of the second mounting holes 2011. In the present embodiment, the number of the first screws 32 is four. In other embodiments, the number of the first screws 32 is other value.

Further, the through hole 311 of the welding key 31 is a conical hole, and the first screw 32 is a countersunk head screw. In this way, the shape of the through hole 311 of the welding key 31 matches with the shape of the first screw 32, and the head of the first screw 32 completely gets into the interior of the through hole 311 of the welding key 31. The advantage of this design is, to prevent the head of the first screw 32 from protruding from the surface of the welding key 31, such that the first screw 32 is hidden in the welding key 31, and the surface of the welding key 31 keeps flat and beautiful. In addition, the user can be prevented from scratching or bruising by the head of the first screw 32 during the usage process. On the other hand, the shape of the through hole 311 of the welding key 31 matches with the shape of the first screw 32, which can further stabilize the first screw 32, such that one screw 32 has a relatively large and flat stress contact surface to prevent the first screw 32 from being loosened.

In the solution of the present invention, the fixation between the hanging rod 10 and the base 20 can be strengthened by the connecting assembly 30. Specifically, through the fixation effect of the first screw 32, an axial displacement or loosening between the hanging rod 10 and the first connection end 201 of the base 20 can be avoided, which ensures the connection accuracy between the hanging rod 10 and the base 20. By disposing the welding key 31 at the side wall of the hanging rod 10, the first screw 32 can be strengthened, making the first screw 31 have a relatively large stress contact surface to prevent the first screw 31 from dropping off.

The chair 40 is suspended at the hanging rod 10. Specifically, the chair 40 is suspended at the suspension loop 111 of the first rod piece 11. The chair 40 includes a chair frame 41 and a cover cloth 42.

Figure 11:
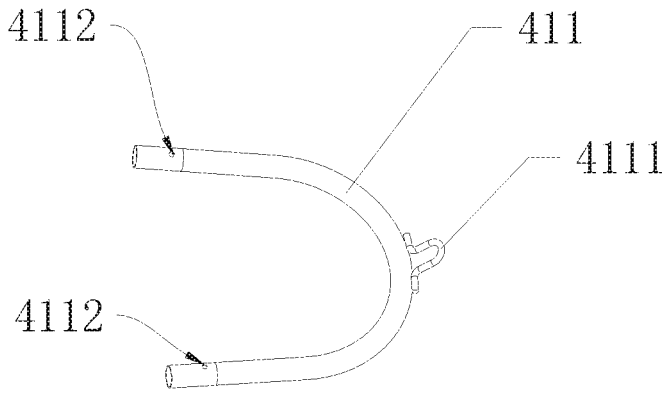
FIG. 11 is a structural schematic diagram of a first bend pipe of the hanging chair according to an embodiment of the present invention.

The chair frame 41 includes a first bend pipe 411, two second bend pipes 412, a third bend pipe 413 and a straight pipe 414. As shown in FIG. 11, the first bend pipe 411 is U-shaped, the middle part of the first bend pipe 411 has a suspension part 4111, and the suspension part 4111 of the first bend pipe 411 is suspended at the suspension loop 111 of the hanging rod 10. Two ends of the first bend pipe 411 have a through hole 4112, respectively. The through hole 4112 runs through the first bend pipe 411.

Figure 12:
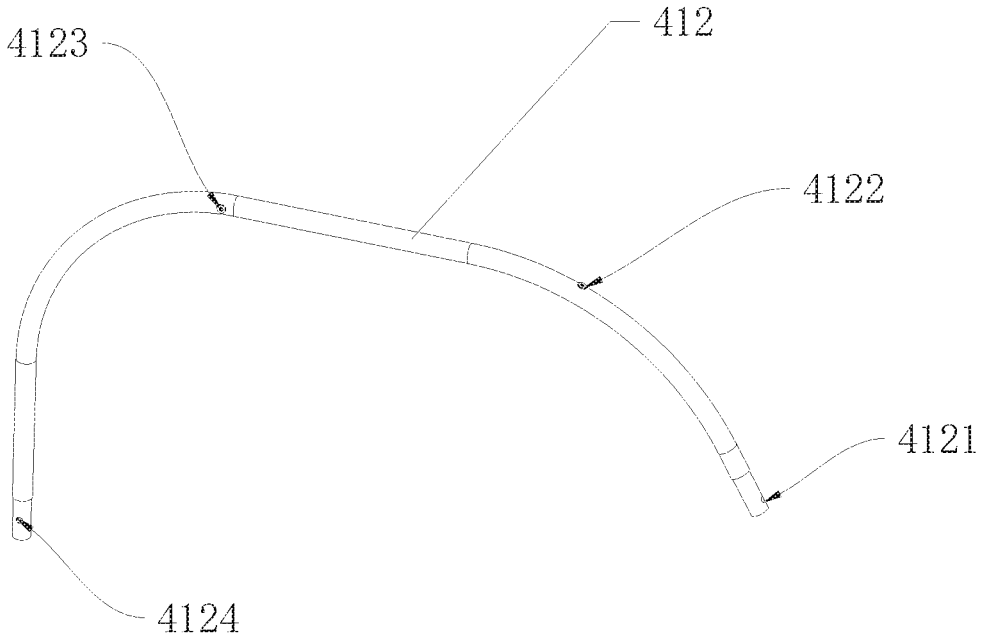
FIG. 12 is a structural schematic diagram of a second bend pipe of the hanging chair according to an embodiment of the present invention.
Figure 13:
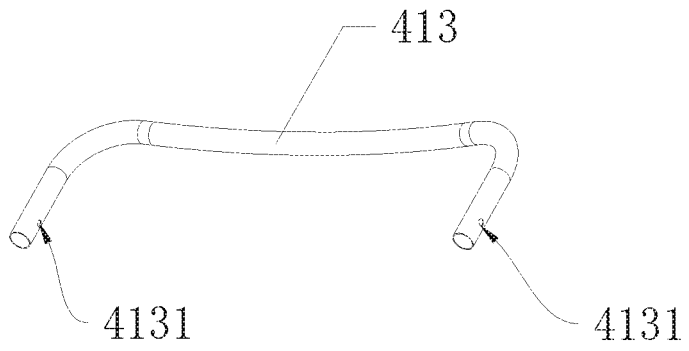
FIG. 13 is a structural schematic diagram of a third bend pipe of the hanging chair according to an embodiment of the present invention.
Figure 14:
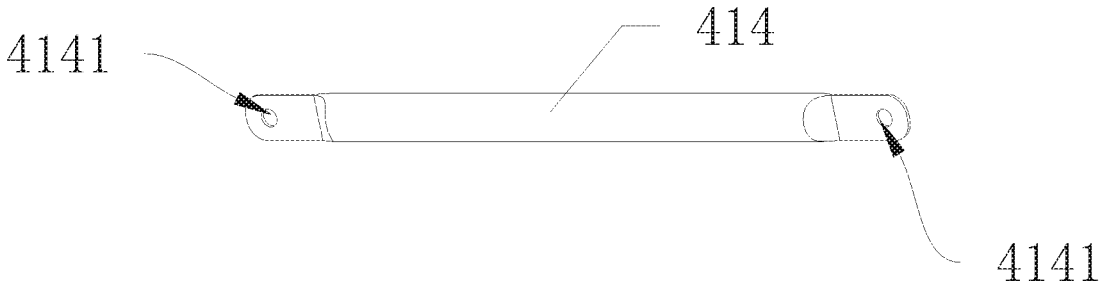
FIG. 14 is a structural schematic diagram of a straight pipe of the hanging chair according to an embodiment of the present invention.

As shown in FIG. 12, the second bend pipe 412 is C-shaped, and one end of the two second bend pipes 412 is inserted and fixed at two ends of the first bend pipe 411 through a screw, respectively. Specifically, the second bend pipe 412 has a first through hole 4121, a second through hole 4122, a third through hole 4133, and a fourth through hole 4124. The first through hole 4121, the second through hole 4122, the third through hole 4123 and the fourth through hole 4124 are sequentially disposed at intervals. That is, the first through hole 4121 is located at one end of the second bend pipe 412, the fourth through hole 4124 is located at the other end of the second bend pipe 412, and the second through hole 4122 and the third through hole 4123 are located between the first through hole 4121 and the fourth through hole 4124, respectively. One end of the two second bend pipes 412 are inserted at two ends of the first bend pipe 411, respectively, such that the through holes 4112 at both sides of the first bend pipe 411 correspond exactly to the first through holes 4121 of the two second bend pipes 412, respectively, and two second bend pipes 412 are respectively fixed at two ends of the first bend pipe 411 according to a way of inserting the screw into the through hole 4112 and the through hole 4121.

The third bend pipe 413 is "[illegible]" shape, and two ends of the third bend pipe 413 are inserted and fixed at the other end of the two second bend pipes 412 through a screw, respectively. In this way, the first bend pipe 411, the two second bend pipes 412 and the third pipe 413 are sequentially end to end connected to form a closed frame. Two ends of the third bend pipe 413 have a through hole 4131, respectively, and two ends of the third bend pipe 413 are inserted to the second bend pipes 412, respectively, such that the fourth through hole 4124 of the second bend pipe 412 corresponds exactly to the through hole 4131 of the third bend pipe 413, and the two second bend pipes 412 are respectively fixed at two ends of the third bend pipe 413 according to a way of inserting the screw into the fourth through hole 4121 and the through hole 4131 of the third bend pipe 413.

Two ends of the straight pipe 414 are fixed at a top of the two second bend pipes 412 through a screw, respectively. Two ends of the straight pipe 414 are flat, and two ends of the straight pipe 414 have a through hole 4141, respectively. Two through holes 4141 of the straight pipe 414 correspond exactly to the second through hole 4122 of the two second bend pipes 412, respectively, and the straight pipe 414 is fixed at the two second bend pipes 412 through a way of inserting the screw into the through hole 4141 of the straight pipe 414 and the second through hole 4122.

Figure 15:
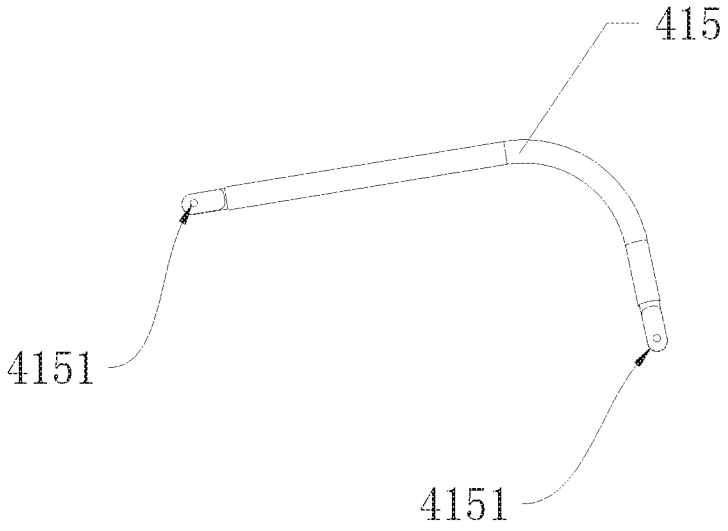
FIG. 15 is a structural schematic diagram of an armrest of the hanging chair according to an embodiment of the present invention.
Figure 16:
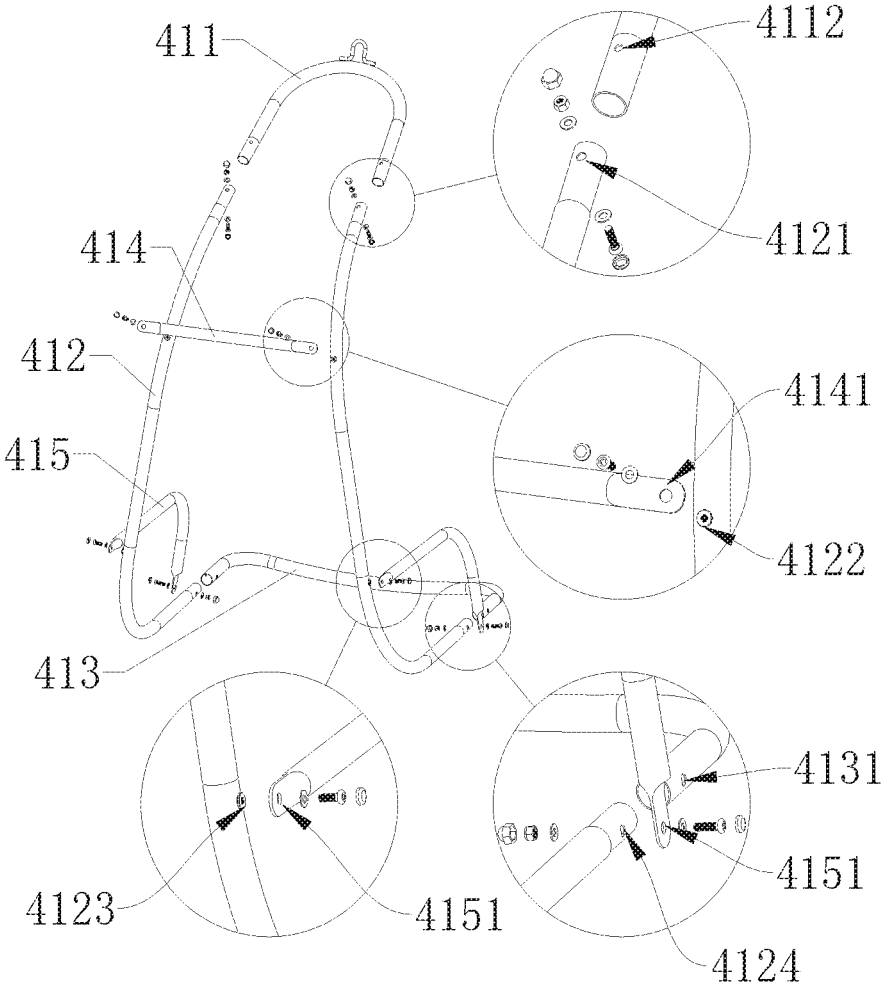
FIG. 16 is a structural exploded view of a chair frame of the hanging chair according to an embodiment of the present invention, showing a connection way between the first bend pipe, the two second bend pipes, the third bend pipe, the straight pipe and the armrest.

Further, the chair frame 41 further includes two armrests 415. As shown in FIG. 15, two ends of each armrest 415 are flat, and two ends of each armrest 415 have a through hole 4151. One end of each armrests 415 is fixed at a junction of one of the second bend pipe 412 and the third bend pipe 413 through a screw, that is, the through hole 4151 of one end of each armrest 415 corresponds exactly to the fourth through hole 4124 of the second bend pipe 412, and the screw is inserted into the fourth through hole 4124, the through hole 4131 of the third bend pipe 413 and the through hole 4151 of the armrest 415 simultaneously to fix the three together. The other end of each armrest 415 is fixed at the other position of one of the second bend pipes 412 through a screw correspondingly. Specifically, the through hole 4151 at the other end of each armrest 415 correspond exactly to the third through hole 4123 of the second bend pipe 412, and the other end of each armrest 415 and the second bend pipe 412 are fixed through a screw.

Four edges of the cover cloth 42 are fixed at two second bend pipes 412, the third bend pipe 413 and the straight pipe 414, respectively, to spread the cover cloth 42. In other embodiments, the cover cloth 42 adopts a bound rope to replace.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A hanging chair; comprising:

a hanging rod, a side wall of one end having at least one first mounting hole;

a base; having a first connection end, wherein a side wall of the first connection end has at least one second mounting hole, and the first connection end and one end of the hanging rod are nested together, such that the first mounting holes correspond exactly to the second mounting holes one to one;

a connecting assembly, comprising at least one welding key and at least one first screw, wherein each welding key has at least one through hole; the welding key is disposed at one of the hanging rod and the first connection end, and each first screw passes through the through hole of one welding key, one first mounting hole and one second mounting hole, such that the hanging rod is fixed with the first connection end; and a chair, detachably suspended at the hanging rod;

wherein the chair comprises a chair frame and a cover cloth, and the chair frame comprises a first bend pipe, two second bend pipes, a third bend pipe and a straight pipe, the first bend pipe is U-shaped, the first bend pipe is suspended at the hanging rod, the second bend pipe is C-shaped, one end of the two second bend pipes are inserted and fixed at two ends of the first bend pipe through a screw, respectively, the third bend pipe is "⌈" shape, two ends of the third bend pipe are inserted and fixed at the other end of the two second bend pipes through a screw, respectively, two ends of the straight pipe are fixed at a top of the two second bend pipes through screws, respectively, and four edges of the cover cloth are fixed at the two second bend pipes, the third bend pipe and the straight pipe, respectively;

wherein the chair comprises two armrests, one end of each armrest is fixed at a junction of one of the second bend pipes and the third bend pipe through a screw, and the other end of each armrest is correspondingly fixed at the other position of one of the second bend pipes through a screw.

2. The hanging chair according to claim 1, wherein the number of the first mounting holes is four, the four first mounting holes are located at two sides of the hanging rod with two as one group, respectively, the number of the second mounting holes is four, the number of the welding keys is two, the number of the through holes of each of the welding keys is two, and the number of the first screws is four.

3. The hanging chair according to claim 2, wherein the first connection end is nested inside the hanging rod, and the welding key is disposed at an outer wall of the hanging rod.

4. The hanging chair according to claim 1, wherein the through hole of the welding key is a conical hole, and the first screw is a countersunk head screw.

5. The hanging chair according to claim 1, wherein the hanging rod comprises a first rod piece, a second rod piece and a second screw, the chair is suspended at one end of the first rod piece, the other end of the first rod piece has a through hole, the welding key is disposed at one end of the second rod piece, the other end of the second rod piece has a through hole, the second rod piece is nested inside the first rod piece such that the through hole of the first rod piece correspond exactly to the through hole of the second rod piece, the second screw passes through the through hole of the first rod piece and the through hole of the second rod piece, and a head part of the second screw partially sinks into the through hole of the first rod piece and closely contacts a side wall of the second rod piece.

6. The hanging chair according to claim 1, wherein the base comprises a chassis and four supporting legs, the first connection end is disposed at the chassis, the chassis has four second connection ends, the four second connection ends extend along four different directions, respectively, and the four supporting legs are one to one correspondingly inserted and fixed at the four second connection ends through a screw, respectively.

* * * * *